US005693456A

United States Patent [19]

Foster et al.

[11] Patent Number: 5,693,456

[45] Date of Patent: Dec. 2, 1997

[54] PHOTOGRAPHIC BLEACHING COMPOSITIONS AND METHOD OF PHOTOGRAPHIC PROCESSING USING MIXTURE OF FERRIC COMPLEXES

[75] Inventors: David George Foster, West Henrietta; Joseph Dunstan Feeney, Fairport, both of N.Y.

[73] Assignee: Eastman Kodak Company, Rochester, N.Y.

[21] Appl. No.: 666,173

[22] Filed: Jun. 19, 1996

Related U.S. Application Data

[63] Continuation-in-part of Ser. No. 595,055, Feb. 1, 1996, abandoned.

[60] Provisional application No. 60/003,863 Sep. 18, 1995.

[51] Int. Cl.[6] ..... G03C 7/42

[52] U.S. Cl. ..... 430/461; 430/393; 430/430

[58] Field of Search ..... 430/393, 430, 430/461

[56] References Cited

U.S. PATENT DOCUMENTS

| | | | |
|---|---|---|---|
| 4,921,779 | 5/1990 | Cullinan et al. | 430/379 |
| 4,960,682 | 10/1990 | Cullinan et al. | 430/393 |
| 4,975,356 | 12/1990 | Cullinan et al. | 430/393 |
| 5,061,608 | 10/1991 | Foster et al. | 430/461 |
| 5,149,618 | 9/1992 | Tappe et al. | 430/393 |
| 5,238,791 | 8/1993 | Tappe et al. | 430/393 |
| 5,508,150 | 4/1996 | Craver et al. | 430/393 |

FOREIGN PATENT DOCUMENTS

| | | | |
|---|---|---|---|
| 0501479A1 | 2/1991 | European Pat. Off. . | |
| 0534086A1 | 7/1991 | European Pat. Off. . | |
| 0 545 464 A1 | 11/1991 | European Pat. Off. | G03C 7/42 |
| 0645674A2 | 3/1995 | European Pat. Off. . | |
| 4226372 | 4/1994 | Germany | 430/393 |

*Primary Examiner*—Hoa Van Le

*Attorney, Agent, or Firm*—J. Lanny Tucker

[57] ABSTRACT

A bleaching composition is a mixture of two ferric complexes with two different aminopolycarboxylic acid complexing ligands. The first complex is formed of a biodegradable aminopolycarboxylic acid, and acts as the primary bleaching agent. The second complex is formed of a less biodegradable aminopolycarboxylic acid, and acts to inhibit biological growth and rust formation. The molar ratio of the first complex to the second complex is at least 2:1. The first complexing ligand is iminodiacetic acid or an alkyliminodiacetic acid. The second complexing ligand is either ethylenediaminetetraacetic acid or propylenediaminetetraacetic acid.

17 Claims, 1 Drawing Sheet

PHOTOGRAPHIC BLEACHING COMPOSITIONS AND METHOD OF PHOTOGRAPHIC PROCESSING USING MIXTURE OF FERRIC COMPLEXES

RELATED APPLICATIONS

This is a Continuation-in-part of U.S. Ser. No. 08/595,055, filed Feb. 1, 1996, now abandoned, based on Provisional U.S. Ser. No. 60/03863 filed Sep. 18, 1995.

FIELD OF THE INVENTION

This invention relates to a photographic bleaching composition containing a mixture of bidentate ferric complexes, one being a bleaching agent and the other acting as a anti-microbial agent. This invention also pertains to method of photographic processing using such a composition.

BACKGROUND OF THE INVENTION

To bleach the silver formed during processing of imagewise exposed color photographic materials, it is common practice to use ferric complexes of polycarboxylic acid salts. Common complexing agents used into the bleaching composition to form ferric complexes are aminopolycarboxylic acids, such as ethylenediaminetetraacetic acid (EDTA). However, EDTA is known to be minimally biodegradable.

A number of publications are directed to bleaching compositions containing readily biodegradable complexing agent. For example, U.S. Pat. No. 5,061,608 (Foster et al) discloses an environmental photographic bleaching solution for use in the color processing of photographic elements that contains as bleaching agent, a potassium salt of a ferric complex of an aminopolycarboxylic acid.

U.S. Pat. No. 5,238,791 (Tappe et al) describes a bleaching solution containing an iron(III) complex salt which at least 20 mol % of the complexing agent is derived from a nitrilotricarboxylic acid, for example nitrilotriacetic acid (NTA), or nitrilodiaceticmonopropionic acid (ADA). The remaining iron(III) complex can be EDTA or propylenediaminetetraacetic acid (PDTA). The pH of the solution is at most 4.5 and the bleaching composition further contains an excess of free complexing agent of 1 to 120 mol %, preferably 5 to 20 mol %, based on the iron complex or the iron complex salt.

According to U.S. Pat. No. 5,238,791, while the nitrilotricarboxylic acid complexing agents are readily biodegradable, they suffer from the disadvantage that their iron complex salts are hydrolyzed excessively in the water wash following the bleach bath as a consequence of the dilution. This leads to the precipitation of iron hydroxide (which is a rust colored precipitate).

DE 4,226,372 describes the uses of additives such as tartaric acid or citric acid to inhibit the formation of iron hydroxide. Although these additives may suppress the formation of iron hydroxide, they do so in a limited way and are sensitive to concentration and other system factors like the rate of the water wash following the bleach bath. Specifically, the use of citric acid can promote the formation of biological growth.

In U.S. Pat. No. 5,149,618 (Tappe et al), bleaching solutions are described as containing at least 50 mol % of one or more ferric complexes of such ligands as ADA with the remainder of the complexes being Fe-EDTA, Fe-PDTA, Fe-NTA or mixtures thereof.

U.S. Pat No. 5,061,608 (Foster et al) describes a rehalogenating bleaching solution that is more environmentally suitable, comprising one or more ferric complexes of aminopolycarboxylic acids. Mixtures noted therein include a mixture of EDTA and PDTA, a mixture of EDTA and methyliminodiacetic acid (MIDA), and a mixture of MIDA and iminodiacetic acid (IDA). No ratios of the complexes are described for such mixtures. Similar mixtures are described in U.S. Pat. No. 4,921,779 (Cullinan et al), U.S. Pat No. 4,960,682 (Cullinan et al) and U.S. Pat No. 4,975,356 (Cullinan et al) for bleaching reversal films.

U.S. Ser. No. 08/222,140 filed Apr. 4, 1994 (EP-A-0 545 464 A1) discloses a photographic bleaching solution that contains the ferric complex of an alkyliminodiacetic acid, such as MIDA, as a bleaching agent. This bleaching solution is advantageously readily biodegradable and provides a high bleaching performance. A shortcoming of this bleaching solution is also the formation of iron hydroxide and biological growth in the wash bath following the bleaching bath.

It would be desirable to provide a photographic bleaching composition that is readily biodegradable, has good bleaching ability, and does not promote the formation of iron hydroxide and biological growth in the wash bath following the bleaching step.

SUMMARY OF THE INVENTION

The problems noted above are solved with a silver halide photographic bleaching composition comprising a mixture of a first ferric aminopolycarboxylic acid complex and a second ferric aminopolycarboxylic acid complex, the first ferric aminopolycarboxylic acid complex being a ferric complex of a first aminopolycarboxylic acid which is either iminodiacetic acid or alkyliminodiacetic acid, and the second ferric aminopolycarboxylic acid being a ferric complex of a second aminopolycarboxylic acid which is either ethylenediaminetetraacetic acid or propylenediaminetetraacetic acid, the molar ratio of the first ferric aminopolycarboxylic complex to the second ferric aminopolycarboxylic acid complex being at least 2:1.

This invention also provides a method of processing a color developed, color photographic silver halide material with the bleaching composition described above.

This invention provides a photographic bleaching composition having good bleaching performance. Further, the bleaching composition inhibits the formation of iron hydroxide and biological growth in the bleaching bath as well as the following wash bath. Moreover, the present bleaching composition is readily biodegradable, since the first ferric complex that is predominant in the mixture, is formed with a readily biodegradable aminocarboxylic acid complexing agent, i.e. either iminodiacetic acid or an alkyliminodiacetic acid. The formation of iron hydroxide and biological growth is unexpectedly inhibited because of the presence of even a very low amount of the second ferric aminopolycarboxylic acid complex formed from either EDTA or PDTA.

DESCRIPTION OF PREFERRED EMBODIMENTS

Figure 1:
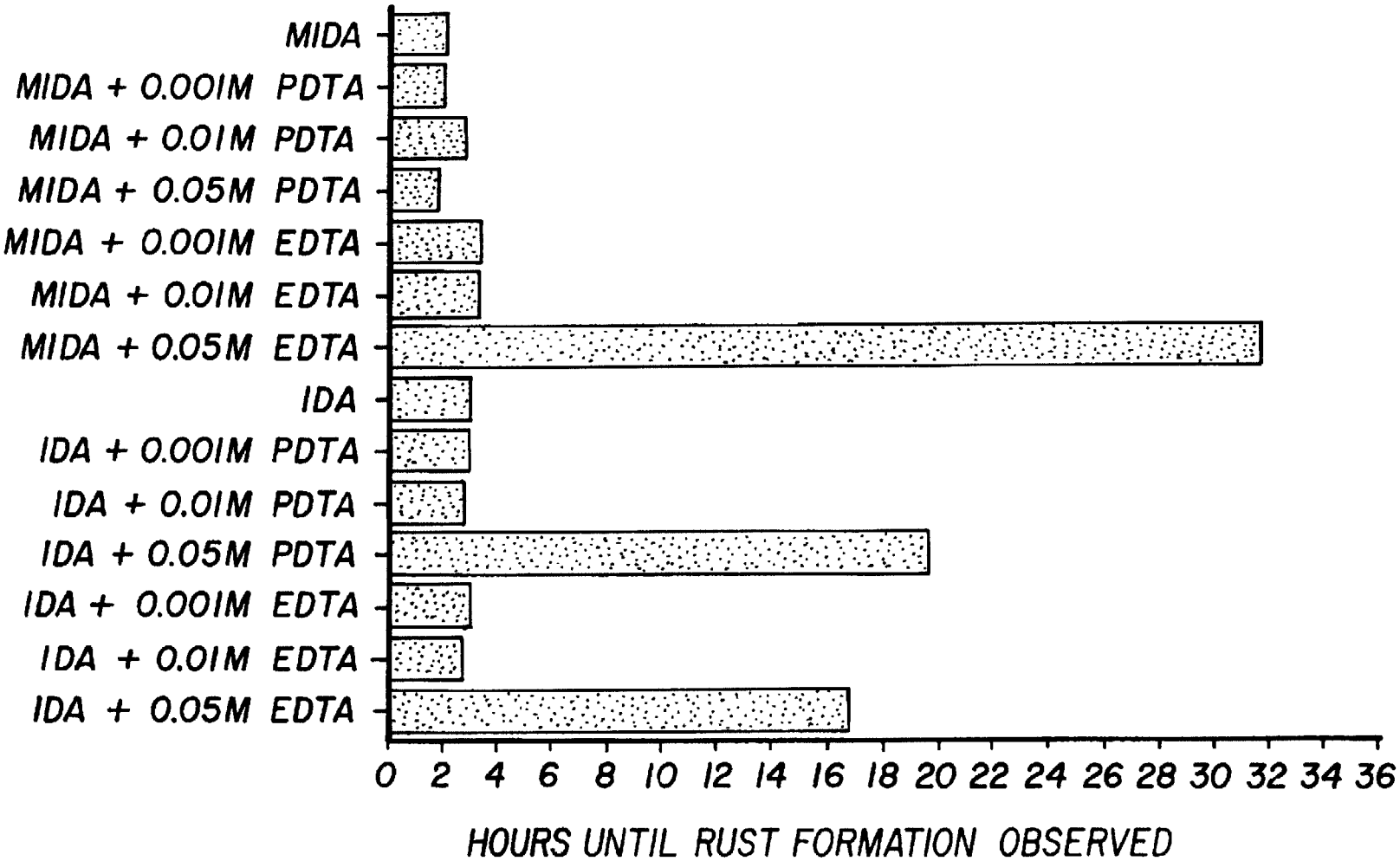
FIG. 1 is a bar graph showing the results of rust formation test described in the Example below.

The mixture of ferric complexes in the bleaching composition of this invention contains a first ferric complex of a first complexing aminopolycarboxylic acid ligand that is iminodiacetic acid (IDA) or an alkyliminodiacetic acid [such as methyliminodiacetic acid (MIDA) or ethyliminodiacetic acid]. These complexing ligands are well known in the art, and can be readily obtained from various commercial sources. Preferably, the first aminopolycarboxylic acid is iminodiacetic acid or methyliminodiacetic acid. The preferred acid is methyliminodiacetic acid.

The first aminopolycarboxylic acid ligand can be used in the free acid form or as a sodium, potassium or ammonium salt.

The second ferric complex used in this invention is composed of ferric ion and either EDTA or PDTA, both well-known aminopolycarboxylic acid ligands. They can be used as free acids or as alkali metal or ammonium salts.

It is not necessary that the iron and the first and second aminopolycarboxylic acid ligands be present in the composition in stoichiometric proportion. It is preferred that the molar ratio of the each ligand to ferric iron be from about 1:1 to 5:1. In a more preferred embodiment, the ratio is about 2 to about 3 moles of each complexing agent per mole of ferric ion.

The molar ratio of the first ferric complex to the second ferric complex is at least 2:1, and preferably it is at least 5:1, with a molar ratio of from 5:1 to 20:1 being more preferred. Even higher molar ratios may be useful also, such as up to 300:1.

Generally speaking the iron is present in from about 2 to about 25 grams per liter. Lower levels of about 2 g/l are commonly used to bleach color paper. Levels of 10–25 g/l are commonly used when rapid bleach action is desired. Levels of about 13 g/l are commonly used to bleach color reversal materials.

In a preferred embodiment, a rehalogenating agent, such as chloride or bromide ions, is present in the composition. The rehalogenating agent can be present in any effective amount, with useful amounts typically being at least 0.1 mol/l and preferably at least 0.20 mol/l. Bromide ions are preferred, especially when the emulsions being processed are predominantly silver bromide. Chloride or bromide ions can be used in the form of potassium, sodium or ammonium salts.

The bleaching composition can also include other addenda that may be useful in bleaching solutions, such as buffers, metal sequestering agents, anti-scumming agents, antioxidants and anti-foam agents.

Water-soluble aliphatic carboxylic acids as described in U.S. Pat. No. 5,061,608 (noted above) can be used in the bleaching composition of the present invention. One or more of these are used in sufficient amount to combat the undesirable increase in blue Dmin that results from bleach induced dye formation as set forth in the noted patent.

The bleaching compositions of this invention are aqueous acidic solutions preferably having a pH from about 2.5 to about 5.0, but a different pH can be used if desired. The pH can be maintained using suitable buffers. A preferred pH is in the range of from about 3.5 to about 4.5.

The compositions of this invention are bleaching compositions and not bleach-fix compositions, and thus they are substantially free of fixing agents or silver solvents.

The bleaching composition of this invention is especially useful in the color processing of photographic elements, including photographic films utilized in negative-positive processes or in color reversal processes and in the processing of color papers using separate bleaching and fixing steps. Useful color negative-positive processes include the steps of color developing, bleaching, fixing and stabilizing or washing. The steps of color reversal processes are well known. Bleaching is generally carried out in less than 6 minutes, but even shorter times may be possible under certain conditions.

The details of such processes including color developing solutions, fixing solutions, stabilizing solutions, conditioning solutions, first developer solutions (for reversal processes), and the color photographic elements processed therein, including emulsions, supports and other details thereof, are well known from hundreds of publications, some of which are listed in *Research Disclosure*, publication 36544, pages 501–541, Sep. 1994, incorporated herein by reference. *Research Disclosure* is a publication of Kenneth Mason Publications Ltd., Dudley House, 12 North Street, Emsworth, Hampshire PO10 7DQ England. Preferred color photographic materials are color negative photographic films.

It is generally convenient for the first and second ferric complex of the invention to be formed in situ in the bleaching solution by reaction of a ferric salt, such as ferric sulfate or ferric nitrate, with the first and second aminopolycarboxylic acid ligands described herein.

While washing is not required, such as in mini-lab processing, in a preferred embodiment, a wash step is included in the processing method of this invention between the bleaching and fixing steps. Washing can be carried out using water or other conventional washing solutions. When washing is used, it is particularly desired that the washing rate in this step be up to about 54,000 ml/m$^2$ of color photographic material processed. A preferred range of washing rates is from about 10,000 to about 35,000 ml/m$^2$, and more preferably, from about 5,000 to about 20,000 ml/m$^2$, and for these rates, it is preferred that the molar ratio of first ferric complex to the second ferric complex noted above if from about 2:1 to about 20:1. As more of the second ferric complex is used in the bleaching solution, the lower the washing rate that is used in the process.

The following example is provided to illustrate the present invention, but the invention is not to be interpreted as so limited. Unless otherwise indicated, percentages are by weight.

EXAMPLE

Bleaching With Various Bleaching Solutions

Samples of KODAK GOLD ULTRA™ 400 Color Film were processed using conventional Process C-41 processing solutions and conditions except for the bleaching solutions, as described below.

All of the bleaching solutions were prepared so that the total ferric ion level was 6.67 g/l (0.12 mol/l ) and the first chelating ligand (either IDA or MIDA) was present at 0.30 mol/l so the ferric ion to first ligand was 1:2.5. The solutions also included acetic acid (50 ml/l ) and potassium bromide (30 g/l), and had a pH of 4.0.

To each solution was added certain amounts (0.001, 0.01 or 0.05 mol/l) of second chelating ligand (either PDTA or EDTA) to provide various molar ratios of first ligand to second ligand (300:1, 30:1 and 6:1, respectively).

The Control A and B bleaching solutions contained ferric complexes with MIDA or IDA alone.

Rust (iron oxide) formation tests were carried out by adding a portion of the bleaching solution (5 ml) to 995 ml of tap water. These solutions were placed in a control temperature bath (38° C.) during the day, and is turned off at night to simulate a processor being turned on and off under normal conditions of use. The times (hours) required for rust formation are shown in FIG. 1. Rust formation was delayed the longest at a molar ratio of about 6:1 of first ferric complex to the second ferric complex. Rust inhibition was best achieved with a combination of MIDA and EDTA in the bleaching solution. A combination of IDA and PDTA was better than a combination of IDA and EDTA.

Processing of the film samples using the various bleaching solutions was also carried out using conventional times and temperatures. The bleaching solution containing MIDA and PDTA was faster than with the solution containing MIDA and EDTA, especially when the molar ratio of first complex to second complex was about 6:1.

This invention has been described above with particular reference to preferred embodiments thereof. A skilled practitioner having the above detailed description can make many substitutions or alterations without departing from the scope or spirit of the appended claims.

We claim:

1. An aqueous silver halide photographic bleach composition comprising a mixture of a first ferric aminopolycarboxylic acid complex and a second ferric aminopolycarboxylic acid complex, ferric ion being present in an amount of from about 2 to about 25 g/l, said first ferric aminopolycarboxylic acid complex being a ferric complex of a first aminopolycarboxylic acid which is either iminodiacetic acid or an alkyliminodiacetic acid, the molar ratio of said first aminopolycarboxylic acid to ferric ion being from about 1:1 to about 5:1, and said second ferric aminopolycarboxylic acid being a ferric complex of a second aminopolycarboxylic acid which is either ethylenediaminetetraacetic acid or propylenediaminetetraacetic acid, the molar ratio of said second aminopolycarboxylic acid to ferric ion being from about 1:1 to about 5:1, the molar ratio of said first ferric aminopolycarboxylic acid complex to said second ferric aminopolycarboxylic acid complex being from 5:1 to 20:1.

2. The bleach composition of claim 1 wherein said first aminopolycarboxylic acid is iminodiacetic acid or methyliminodiacetic acid.

3. The bleach composition of claim 2 wherein said first aminopolycarboxylic acid is methyliminodiacetic acid, and said second aminopolycarboxylic acid is propylenediaminetetraacetic acid.

4. The bleach composition of claim 1 wherein said first aminopolycarboxylic acid is methyliminodiacetic acid, and second aminopolycarboxylic acid is ethylenediaminetetraacetic acid.

5. The bleach composition of claim 1 having a pH of from 2.5 to about 5.0.

6. The bleaching composition of claim 1 further comprising a rehalogenating agent.

7. A method of processing a color silver halide photographic material, said method comprising bleaching a color developed, color photographic material with a bleaching composition comprising a mixture of a first ferric aminopolycarboxylic acid complex and a second ferric aminopolycarboxylic acid complex, ferric ion being present in an amount of from about 2 to about 25 g/l, said first ferric aminopolycarboxylic acid complex being a ferric complex of a first aminopolycarboxylic acid which is either iminodiacetic acid or an alkyliminodiacetic acid, the molar ratio of said first aminopolycarboxlic acid to ferric ion being from about 1:1 to about 5:1, and said second ferric aminopolycarboxylic acid being a ferric complex of a second aminopolycarboxylic acid which is either ethylenediaminetetraacetic acid or propylenediaminetetraacetic acid, the molar ratio of said second aminopolycarboxylic acid to ferric ion being from about 1:1 to about 5:1, the molar ratio of said first ferric aminopolycarboxylic acid complex to said second ferric aminopolycarboxylic acid complex being from 5:1 to 20:1.

8. The method of claim 7 wherein said color photographic material is a color negative photographic film.

9. The method of claim 7 wherein said bleaching is carried out for less than 6 minutes.

10. The method of claim 7 wherein said first aminopolycarboxylic acid is iminodiacetic acid or methyliminodiacetic acid.

11. The method of claim 7 wherein said first aminopolycarboxylic acid is methyliminodiacetic acid and said second aminopolycarboxylic acid is propylenediaminetetraacetic acid.

12. The method of claim 7 wherein said first aminopolycarboxylic acid is methyliminodiacetic acid, and said second aminopolycarboxylic acid is ethylenediaminetetraacetic acid.

13. The method of claim 7 wherein said bleaching composition has a pH of from 2.5 to about 5.0 and comprises a rehalogenating agent.

14. The method of claim 7 further comprising fixing said color photographic material after said bleaching.

15. The method of claim 14 further comprising a washing step between bleaching and fixing of said color photographic material.

16. The method of claim 15 wherein the rate of washing in said washing step is from about 10,000 to about 35,000 $ml/m^2$ of said color photographic material.

17. The method of claim 16 the rate of washing in said washing step is from about 5,000 to about 20,000 $ml/m^2$ of said color photographic material.

* * * * *